United States Patent [19]

Nayak et al.

[11] Patent Number: 4,473,450

[45] Date of Patent: Sep. 25, 1984

[54] ELECTROCHEMICAL METHOD AND APPARATUS

[75] Inventors: Vidya J. Nayak, San Jose; James P. Reed, San Francisco; Jeff C. Curtis, Redwood City, all of Calif.

[73] Assignee: Raychem Corporation, Menlo Park, Calif.

[21] Appl. No.: 485,572

[22] Filed: Apr. 15, 1983

[51] Int. Cl.[3] ..... C23F 13/00

[52] U.S. Cl. ..... 204/147; 204/196; 204/294

[58] Field of Search ..... 204/290 R, 294, 147, 204/148, 196, 197; 427/77

[56] References Cited

U.S. PATENT DOCUMENTS

| | | | |
|---|---|---|---|
| 3,151,050 | 9/1964 | Wilburn | 204/196 |
| 3,260,661 | 7/1966 | Kemp | 204/197 |
| 3,868,313 | 2/1975 | Gay | 204/196 |
| 3,887,449 | 6/1979 | Baer | 204/148 |
| 4,091,291 | 5/1978 | Foster | 204/196 |
| 4,117,065 | 9/1978 | Tsien et al. | 264/105 |
| 4,186,075 | 1/1980 | Kempter | 204/294 |
| 4,255,241 | 3/1981 | Kroon | 204/147 |
| 4,285,796 | 8/1981 | Stoner | 204/290 F |
| 4,294,893 | 10/1981 | Iemmi | 204/294 |
| 4,369,104 | 1/1983 | Beekley | 204/294 |

FOREIGN PATENT DOCUMENTS

| | | | |
|---|---|---|---|
| 34293 | 10/1973 | Japan | 204/196 |
| 48948 | 5/1978 | Japan | 204/196 |
| 1323417 | 7/1973 | United Kingdom . | |

*Primary Examiner*—John F. Niebling

*Attorney, Agent, or Firm*—Timothy H. P. Richardson

[57] ABSTRACT

Electrodes for electrochemical processes, especially anodes for impressed current systems for corrosion prevention, have an electrochemically active outer surface comprising a first element, preferably a conductive polymer element, and a plurality of second elements, preferably carbon or graphite fibers, which are partially embedded in the second element and which are electrochemically more active than the first element.

22 Claims, 6 Drawing Figures

ELECTROCHEMICAL METHOD AND APPARATUS

FIELD OF THE INVENTION

This invention relates to electrodes for use in electrochemical processes.

INTRODUCTION TO THE INVENTION

It is well known to carry out electrochemical reactions by maintaining a potential difference between two electrodes which are exposed to and electrically connected by at least one electrolyte. A particularly important electrochemical reaction is the prevention of corrosion of a substrate by maintaining a potential difference between the substrate and an electrode so that a small current passes between the electrode and the substrate.

Copending and commonly assigned patent application Ser. No. 272,854 (now abandoned) and the continuation-in-part thereof, Ser. No. 403,203, the disclosures of which are incorporated by reference herein, describe electrodes which are particularly useful as distributed anodes in impressed current systems for corrosion prevention. The electrodes comprise an electrically active outer surface provided by an element which is composed of a conductive polymer and which is at least 500 microns thick. Preferred electrodes are flexible and comprise a highly conductive core, e.g. a metal wire, surrounded by an element which is composed of a conductive polymer having an elongation of at least 10% and which provides substantially the whole of the electrochemically active outer surface of the electrode.

U.S. Pat. No. 4,117,065 (Tsien) describes a method of making an electrode which is suitable for use as a cathode in a fuel cell, by bombarding a conductive polymer element with a mixture of compacted carbon and metal particles, preferably zinc particles.

SUMMARY OF THE INVENTION

We have found that failure of conductive polymer anodes of the type described above takes place when the conductive polymer element degrades to a condition which permits moisture and/or electrochemical reaction products to attack the metal core of the electrode. Degradation of the conductive polymer appears to take place progressively from the exposed surface as a result of electrochemically induced reaction of the carbon black and/or polymer, resulting in permeability which permits ingress of electrolyte etc. With the known electrodes such permeability can be observed in a relatively short time, e.g. about a week, if the current density at the surface of the anode is greater than about 0.05 milliamps/cm$^2$. (Current densities given herein are based on the geometric area of the electrode.) At lower current densities, initiation of the failure mechanism takes longer, but improvement is still needed.

We have now discovered that improved electrodes have an electrochemically active surface which comprises (a) the exposed surface of a first element, preferably an element which is composed of a conductive polymer and is at least 500 microns thick, and (b) the exposed surfaces of a plurality of second elements, preferably carbon fibers or graphite fibers, which are partially embedded in, and project from the exposed surface of, the first element. The second elements are composed of a material such that the electrochemical reaction at the surface of the electrode takes place preferentially on the second elements.

In one aspect, the invention provides a method of carrying out an electrochemical reaction which comprises maintaining a potential difference between an anode and a cathode which are exposed to and electrically connected by at least one electrolyte, wherein the anode has an electrochemically active outer surface which comprises (a) the exposed surface of a first element and
(b) the exposed surfaces of a plurality of second elements which are partially embedded in, and project from the exposed surface of, the first element, the exposed surfaces of the first and second elements being such that the desired electrochemical reaction at the anode takes place preferentially on the exposed surfaces of the second elements. In a particularly preferred embodiment of this method, an electrically conductive substrate is protected from corrosion by maintaining a potential difference between the substrate as cathode and an anode whose electrochemically active outer surface is provided by (a) the exposed surface of a first element which is composed of a conductive polymer and which is at least 500 microns thick, and
(b) the exposed surfaces of a plurality of second elements which
  (i) are in the form of fibers,
  (ii) are partially embedded in, and project from the exposed surface of, the first element, and
  (iii) are composed of a material selected from carbon and graphite.

In another aspect, the invention provides a method of carrying out an electrochemical reaction which comprises maintaining a potential difference between an anode and a cathode which are exposed to and electrically connected by an electrolyte, wherein at least one of the anode and cathode has an electrochemically active outer surface which comprises (a) the exposed surface of a first element which is composed of a conductive polymer and which is at least 500 microns thick, and
(b) the exposed surfaces of a plurality of second elements which are in the form of fibers, and which are partially embedded in, and project from the exposed surface of the first element, the exposed surfaces of the first and second elements being such that the electrochemical reaction at that electrode takes place preferentially on the exposed surfaces of the second elements.

In another aspect, the invention provides an article which is suitable for use as an anode in electrochemical processes and which comprises:

(a) a core which is composed of a conductive material having a resistivity at 23° C. of less than $10^{-2}$ ohm.cm;
(b) means for connecting the core to a power supply;
(c) a first element which (i) electrically surrounds the core, (ii) provides part of the electrochemically active outer surface of the article, (iii) is at least 500 microns thick, and (iv) is composed of a first material which is substantially less liable to corrosion than the conductive material of the core; and
(d) a plurality of second elements which (i) provide at least part of the remainder of the electrochemically active outer surface of the article, (ii) are partially embedded in, and project from, the exposed surface of, the first element, and (iii) are composed of a second material such that, when the article is used as an anode, electrochemical reaction takes place preferentially on the exposed surfaces of the second elements rather than any other component of the electrochemically active outer surface.

In another aspect, the invention provides a method of making an article which is suitable for use as an electrode in electrochemical processes, which method comprises (1) forming a first element of a thermoplastic conductive polymer; and (2) pressing against the surface of the first element, while it is softened e.g. by heat or by the action of a suitable solvent, a plurality of second elements which are in the form of fibers, thereby partially embedding at least some of said fibers in the surface of the first element, the second elements having exposed surfaces which are more electrochemically active than the exposed surface of the first element.

BRIEF DESCRIPTION OF THE DRAWING

The invention is illustrated in the accompanying drawing, in which.

DETAILED DESCRIPTION OF THE INVENTION

Figure 1:
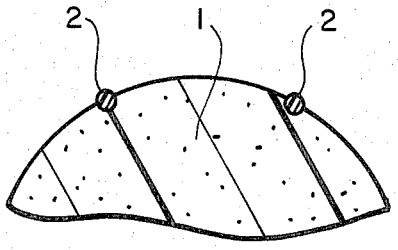
FIGS. 1, 2 and 3 are diagrammatic cross-sectional views of small sections of the exposed electrochemically active surfaces of electrodes of the invention.

The first element in the electrodes of the invention is preferably composed of a conductive polymer, this term being used herein to denote a composition which comprises a polymer component and, dispersed in the polymer component, a particulate conductive filler which has good resistance to corrosion, especially carbon black or graphite or both. For many uses, especially when the electrode is an elongate electrode to be used for corrosion protection, the conductive polymer is preferably flexible, having an elongation at 25° C. of at least 10%, particularly at least 25%. The conductive polymer is preferably thermoplastic, so that the second elements can be partially embedded therein by a process as outlined above; it can if desired be cross-linked, by radiation or otherwise. Preferably the electrode comprises a highly conductive core, particularly of resistivity less than $10^{-2}$ ohm.cm, especially less than $5\times10^{-4}$ ohm.cm particularly less than $3\times10^{-5}$, e.g. of copper or another material, especially a metal wire which is the core of an elongate electrode and which has a suitably low resistance, preferably less then $10^{-2}$ ohm/ft (0.03 ohm/m), particularly less than $10^{-3}$ ohm/ft (0.003 ohm/m), especially less than $10^{-4}$ ohm/ft (0.0003 ohm/m). The core is electrically surrounded by the first element (i.e. all electrical current passing from the core to the electrolyte passes through the first element) so that the electrolyte cannot contact and corrode the core. For elongate electrodes, the first element is preferably melt-extruded around the core so that it forms an annular coating of constant cross-section around the core. However, other arrangements are possible, e.g. the core can have some sections coated with an insulating polymer and other sections coated with a conductive polymer. The thickness of the first element is preferably at least 500 microns, especially at least 1000 microns. For further details of suitable conductive polymers and cores, reference may be made to Ser. Nos. 272,854 and 403,203 incorporated by reference herein.

As noted previously, the presence of the partially embedded second elements results in a substantial improvement in the properties of the electrodes. It is theorized that the improvement results at least in part from the ability of damaging electrochemical reaction products to escape more easily if they are generated on the protruding portions of the second elements than they can if they are generated within the mass of conductive polymer.

The second elements are preferably in the form of fibers, particularly continuous multifilament or monofilament yarns, which can easily be embedded in the conductive polymer and which can if desired provide a high ratio of exposed element to embedded element. However, other particulate forms can be used. The second elements preferably project from the first element by a distance of at least 10 microns and can project for very much more, e.g. an inch or more in some embodiments. Fibrous second elements can be partially embedded throughout their length or can be partially or completely embedded in some longitudinal sections and not embedded at all in other longitudinal sections which may be for example at least 0.1 inch, often at least 0.5 inch long. When using a multifilament yarn, the individual filaments can run generally parallel to the surface of the conductive polymer with spaced-apart sections at least partially embedded in the conductive polymer. The total volume of the portions of the fibers embedded in the conductive polymer may be for example 5 to 80% of the total volume of the fibers. The yarns can be in the form of individual yarns or in the form of a woven, knitted or braided fabric. Such a fabric can contain other fibers which play no part in the electrochemical function of the electrode.

The second elements must provide a preferred site for the electrochemical reaction. Second elements comprising carbon or graphite are preferred for corrosion prevention, but other materials, e.g. transition metal oxides such as rutheniumoxide, can be used, and may be more appropriate in other systems. The second element may be of uniform composition throughout, e.g. a carbon or graphite fiber, or can comprise a core of one material and an outer coating of another, e.g. graphite modified with rutheniumoxide or an appropriately coated glass fiber.

Electrodes of the invention can conveniently be produced by methods in which the fibers which provide the second elements are partially impressed into the heat-softened surface of a conductive polymer first element. In one preferred method, the conductive polymer is melt-extruded around a metal core, using a crosshead die, and as the shaped conductive polymer emerges from the die, or shortly thereafter, a plurality of multifilament yarns, running parallel to the extrusion axis, are contacted with the hot polymer surface, using sufficient pressure to provide the desired partial embedment. Alternatively, at least the surface of a preformed conductive polymer first element can be softened by heat and the second elements contacted with the heat-softened surface.

Figure 2:
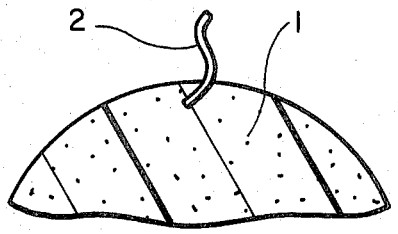
Figure 3:
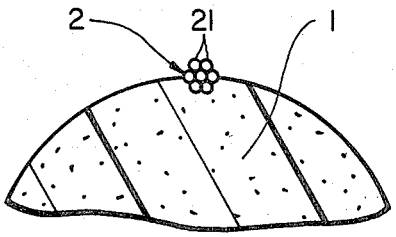

Referring now to the drawing, FIGS. 1 to 3 show different types of partial embedment of the second element 2 in the first element 1, which is composed of conductive polymer. In FIG. 1, the second element is a fiber or particle which is partially embedded throughout its length. In FIG. 2, the second element is a fiber having one end completely embedded and the other end completely free. In FIG. 3, the second element is a multifilament yarn containing a plurality of individual yarns 21, some of which are embedded while others are not (of course, in other locations, some of the individual yarns which are embedded in this cross-section would not be embedded, and vice versa).

Figure 4:
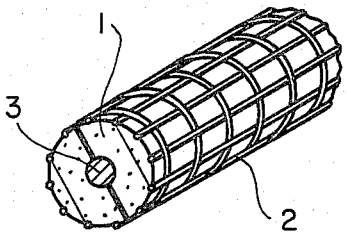
FIGS. 4 to 6 are diagrammatic isometric views, partly in cross section, of electrodes of the invention.
Figure 5:
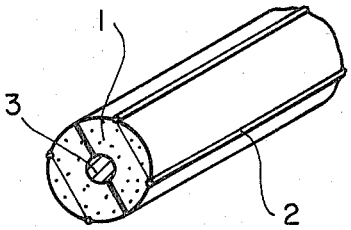
Figure 6:
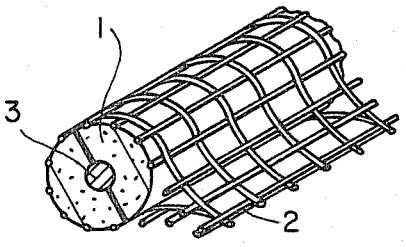

FIGS. 4 to 6 show different electrodes of the invention, each comprising a conductive polymer first element 1, fibrous second elements 2 and a metal core 3.

The invention is illustrated by the following Examples, in which parts and percentages are by weight. Example 1 is an example of the invention. The other Examples are comparative Examples.

EXAMPLE 1

An electrode was produced by melt-extruding, around a nickel-plated copper stranded wire, a composition containing 42.8 parts of a thermoplastic rubber (TPR 5490 from Uniroyal), 50 parts of Shawinigan Acetylene black, 2 parts of calcium carbonate, 5 parts of a processing aid and 0.2 parts of an antioxidant. The coated product had a diameter of ⅜ inch. At the same time, six strands of graphite fiber were passed through the die, so that the final product was similar to that shown diagrammatically in FIGS. 3 and 5. Samples of the electrode were tested by making it the anode in a 3% sodium chloride solution. At a current density of 0.1 $mA/cm^2$, the electrode showed no signs of ingress of electrolytes resulting from permeability. At a current density of 0.2 $mA/cm^2$, the electrode showed no signs of ingress after 33 days. At current densities of 0.3 and 0.4 $mA/cm^2$, there was noticeable ingress after 33 days.

EXAMPLE 2

An electrode was produced and tested as in Example 1 except that the strands of graphite fiber were not partially embedded in the surface of the conductive polymer as it was extruded. When tested at 0.1 $mA/cm^2$, there was marked ingress within about two weeks.

We claim:

1. A method for protecting an electrically conductive substrate from corrosion by maintaining a potential difference between the substrate as cathode and an anode, the anode having an electrochemically active outer surface which comprises
   (a) the exposed surface of a first element which is composed of a conductive polymer and which is at least 500 microns thick, said conductive polymer comprising a polymer component and, dispersed in the polymer component, a particulate conductive filler which has good resistance to corrosion, and
   (b) the exposed surfaces of a plurality of second elements which
      (i) are in the form of fibers,
      (ii) are partially embedded in, and project from the exposed surface of, the first element, and
      (iii) are composed of a material selected from carbon and graphite.

2. A method according to claim 1 wherein the conductive polymer comprises a polymeric component and a conductive filler which is dispersed in the polymeric component and which is composed of at least one of carbon black and graphite.

3. A method according to claim 1 wherein the second elements are in the form of a multifilament yarn.

4. A method according to claim 1 wherein the second elements project from the exposed surface of the first element by a distance of at least 10 microns.

5. A method according to claim 1 wherein at least some of the second elements comprise first longitudinal sections which are at least partially embedded in the first element and second longitudinal sections which are connected to the first sections and do not contact the first element and which are at least 0.1 inch long.

6. A method according to claim 5 wherein the second longitudinal sections are at least 0.5 inch long.

7. A method according to claim 1 wherein the total volume of the portions of the fibers embedded in the first element is 5 to 80% of the total volume of the fibers.

8. A method according to claim 1 wherein the anode is a flexible elongate electrode and comprises a continuous elongate flexible core which (i) is composed of a material having a resistivity at 23° C. of less than $10^{-2}$ ohm.cm and (ii) has a resistance at 23° C. of less than 0.03 ohm/meter, and wherein the first element (i) has an elongation of at least 10% and a resistivity at 23° C. of 0.1 to $10^3$ ohm.cm, and (ii) electrically surrounds the core.

9. An article which is suitable for use as an anode in methods for protecting electrically conductive substrates from corrosion and which comprises:
   (a) a core which is composed of a conductive material having a resistivity at 23° C. of less than $10^{-2}$ ohm.cm;
   (b) means for connecting the core to a power supply;
   (c) a first element which (i) electrically surrounds the core, (ii) provides part of the electrochemically active outer surface of the article, (iii) is at least 500 microns thick, and (iv) is composed of a conductive polymer, said conductive polymer comprising a polymer component and, dispersed in the polymer component, a particulate conductive filler which has good resistance to corrosion, and
   (d) a plurality of second elements which (i) provide at least part of the remainder of the electrochemically active outer surface of the article, (ii) are partially embedded in, and project from the exposed surface of, the first element, and (iii) are composed of a material selected from carbon and graphite.

10. A method of making an article which is suitable for use as an anode in methods for protecting electrically conductive substrates from corrosion, which method comprises
   (1) forming a first element of a thermoplastic conductive polymer; said conductive polymer comprising a polymer component and, dispersed in the polymer component, a particulate conductive filler which has good resistance to corrosion; and
   (2) pressing against the surface of the first element, while it is soft, a plurality of second elements which are selected from carbon fibers and graphite fibers, thereby partially embedding at least some of said fibers in the surface of the first element.

11. An article according to claim 9 wherein the second elements are in the form of a multifilament yarn.

12. An article according to claim 9 wherein the second elements project from the exposed surface of the first element by a distance of at least 10 microns.

13. An article according to claim 9 wherein at least some of the second elements comprise first longitudinal sections which are at least partially embedded in the first element and second longitudinal sections which are connected to the first sections and do not contact the first element and which are at least 0.1 inch long.

14. An article according to claim 9 wherein the second longitudinal sections are at least 0.5 inches long.

15. An article according to claim 9 wherein the total volume of the portions of the fibers embedded in the first element is 5 to 80% of the total volume of the fibers.

16. An article according to claim 9 wherein the second elements are in the form of a multifilament yarn.

17. An article according to claim 9 wherein the second elements are pressed against the first element so that the second elements project from the exposed surface of the first element by a distance of at least 10 microns.

18. An article according to claim 9 wherein the conductive polymer comprises a polymeric component and a conductive filler which is dispersed in the polymeric component and which is composed of at least one of carbon black and graphite.

19. A method according to claim 10 wherein the conductive polymer comprises a polymeric component and a conductive filler which is dispersed in the polymeric component and which is composed of at least one of carbon black and graphite.

20. A method according to claim 10 wherein the second elements are pressed against the first element so that at least some of the second elements comprise first longitudinal sections which are at least partially embedded in the first element and second longitudinal sections which are connected to the first sections and do not contact the first element and which are at least 0.1 inch long.

21. A method according to claim 10 wherein the second longitudinal sections are at least 0.5 inch long.

22. A method according to claim 10 wherein the total volume of the portions of the fibers embedded in the first element is 5 to 80% of the total volume of the fibers.

* * * * *